United States Patent [19]

Kirilloff et al.

[11] Patent Number: 4,651,124

[45] Date of Patent: Mar. 17, 1987

[54] FRAME SUPPORTED GRID RESISTOR

[75] Inventors: Victor V. Kirilloff, Murrysville; William A. Benson, Pittsburgh; Robert Cummins, Pittsburgh; Richard S. Dawson, Pittsburgh, all of Pa.

[73] Assignee: Mosebach Manufacturing Company, Pittsburgh, Pa.

[21] Appl. No.: 649,075

[22] Filed: Sep. 10, 1984

Related U.S. Application Data

[63] Continuation-in-part of Ser. No. 598,725, Apr. 10, 1984, abandoned.

[51] Int. Cl.[4] ..... H01C 3/00

[52] U.S. Cl. ..... 338/280; 338/281; 219/532; 219/531; 219/537; 219/539

[58] Field of Search ..... 338/279, 280, 281, 283, 338/287, 290–315, 318, 326; 219/532, 536, 537, 539, 542, 552, 375, 382, 531

[56] References Cited

U.S. PATENT DOCUMENTS

| | | |
|---|---|---|
| 1,550,641 | 8/1925 | Whittingham . |
| 1,569,415 | 1/1926 | Woodson . |
| 1,695,234 | 12/1928 | Fuller . |
| 2,537,796 | 1/1951 | Sieklucki et al. . |
| 3,237,142 | 2/1966 | Nuss . |
| 3,673,387 | 6/1972 | Drugmand et al. . |
| 3,858,149 | 12/1974 | Kirilloff . |
| 4,011,395 | 3/1977 | Beck . |
| 4,051,452 | 9/1977 | Luy . |
| 4,100,526 | 7/1978 | Kirilloff et al. . |
| 4,316,172 | 2/1982 | Luy . |
| 4,359,710 | 11/1982 | Luy . |

*Primary Examiner*—E. A. Goldberg
*Assistant Examiner*—M. Lateef
*Attorney, Agent, or Firm*—Buell, Ziesenheim, Beck & Alstadt

[57] ABSTRACT

A rigid frame supported resistor for dynamic braking of electric and diesel-electric locomotives has certain of the frame elements cushioned or insulated from each other and the resistance ribbon insulated and cushioned from the frame. Organic insulating material in molded or sheet form, preferably a copolymer, such as a polyester resin, protected by a metal heat shield, may be used for structural frame members, or for cushioning and insulating metal structural frame members. The organic insulating resistant is supplemented by ceramic insulating material in locations subject to high heat.

23 Claims, 13 Drawing Figures

FRAME SUPPORTED GRID RESISTOR

This application is a continuation-in-part of our application Ser. No. 598,725 now abandoned, filed Apr. 10, 1984 captioned INSULATED METAL FRAME SUPPORTED RESISTOR.

This invention relates to frame supported resistors used in electric and diesel-electric locomotives for dynamic braking. It is more particularly concerned with such resistors having frames partially or entirely of metal provided with insulating members which increase resistance to shock and withstand heat.

Resistors with frames at least partially of metal are widely used for dynamic braking in electric locomotives. The resistance element is generally a flat ribbon fan-folded and supported within the frame by insulating members. The frame is constructed so that several resistors can be stacked in grid form. A typical resistor of that type is disclosed in Kirilloff et al., U.S. Pat. No. 4,100,526. The insulating material must withstand the heat dissipated by the resistance element and has conventionally been inorganic material such as transite, steatite or asbestos. Those materials are brittle and have relatively low resistance to shock. Luy U.S. Pat. No. 4,316,172 discloses a resistor structure in which the insulating material between resistor and frame is a hot molded organic compound. A disadvantage of organic materials is their relatively low heat tolerance and in Luy's apparatus the loops of the fan-folded strip are spaced from his organic material by metal clips. The length required of the clips increase the over-all dimensions of the resistor frame.

SUMMARY OF THE INVENTION

Our invention comprises a compact resistor in which certain of the frame elements are cushioned or insulated from others and in which the resistance ribbon is insulated and cushioned from the frame. Organic material is used for cushioning and for insulating, supplemented in locations subject to high heat by ceramic material in the form of bushings or the like. The organic material may be molded or in sheet form and is preferably a copolymer, such as a polyester resin, which has a higher resistance to shock than the insulating materials used heretofor in such devices. Its cushioning properties considerably improve the shock resistance of our resistor and the ceramic bushings where required provide effective electrical insulation at high temperatures without requiring an increase in dimensions of the frame. If desired the resistor may embody a metal heat shield for the organic insulating material to provide an air channel therebetween and the width of that channel may be adjusted in response to the expansion and contraction of the resistance element.

DESCRIPTION OF PREFERRED EMBODIMENTS

Figure 1:
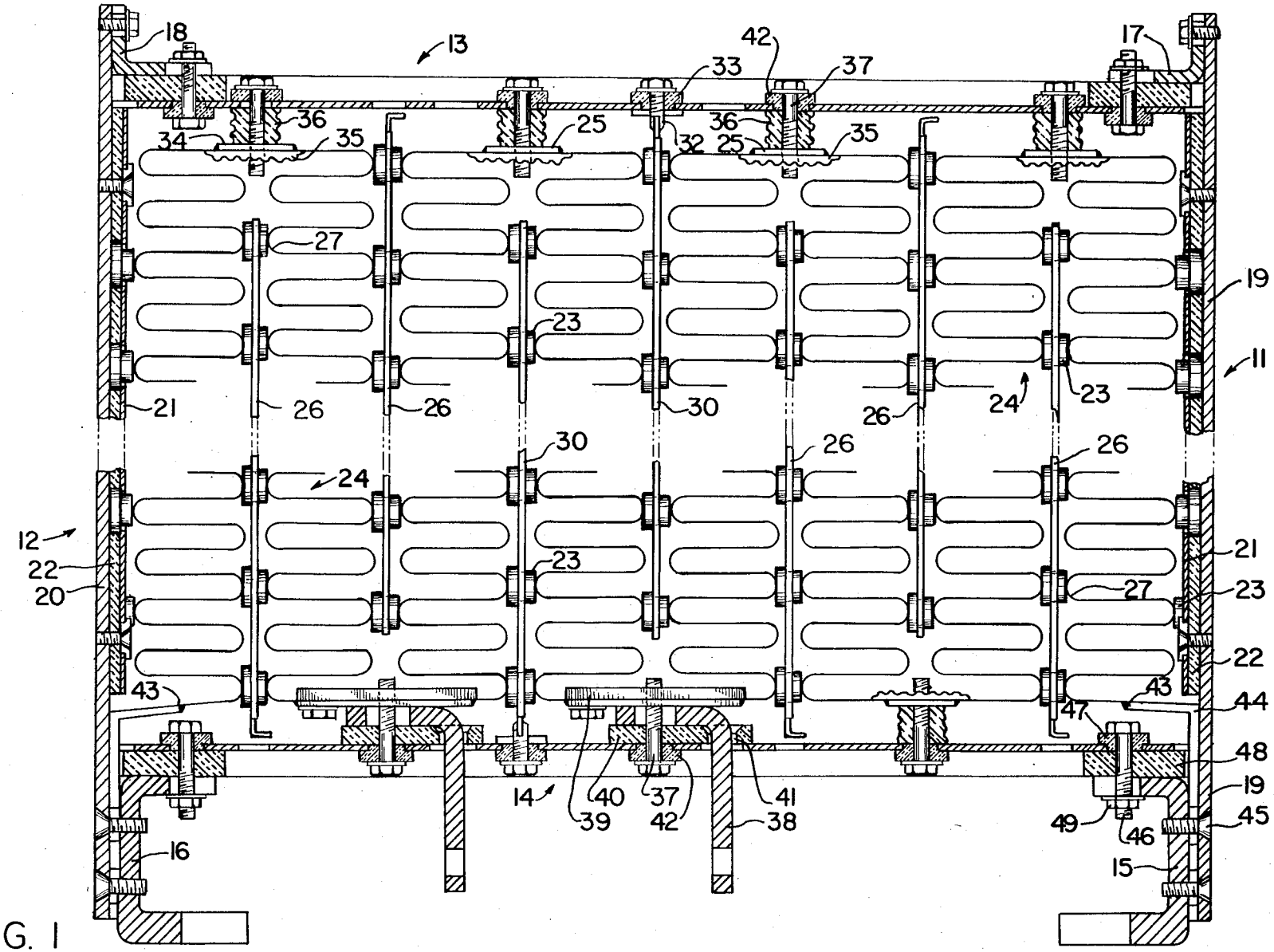
FIG. 1 is a section through a first embodiment of our resistor in elevation.

The first embodiment of our resistor, shown in FIG. 1, is mounted in a rectangular frame comprising end members 11 and 12 and side members 13 and 14. Side member 13 is sometimes referred to hereinafter as the top or top member and side member 14 as the bottom or bottom member, although the frame may be otherwise mounted. End members 11 and 12 extend below member 14 and are affixed to end terminals 15 and 16 respectively which also form mounting means. End members 11 and 12 also extend above side members 13 and are connected thereto by angles 17 and 18 respectively, as will be described hereinafter.

End member 11 comprises an outside plate 19 of metal, preferably steel, bolted at its upper end to angle 17 and at its lower end to terminal 15. End member 12 comprises a like outside plate 20 bolted at its upper end to angle 18 and at its lower end to terminal 16. Spaced from the inside face of plate 19 by a panel of organic insulating material 22 is a metal heat shield 21, preferably steel, and a like heat shield 21 is also spaced from the inside face of plate 20 by a like insulating panel 22. Panels 22 also carry ceramic bushings 23 which support the fan-folded resistor strip as will be described hereinafter.

Figure 7:
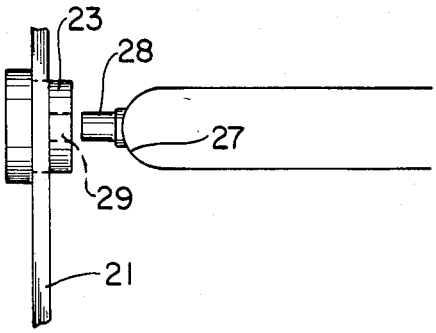
FIG. 7 is a detail of resistor stud and mounting bushing.

The resistance element itself, as is shown in FIG. 1, comprises 8 ribbon-typed fan-folded resistors 24 extending from top 13 to bottom 14 connected in series by metal connector plates 25. Certain loops 27 of resistors 24 which adjoin metal panel 21 carry studs 28 which fit into holes 29 of ceramic bushings 23 as is shown in FIG. 7. Between some adjoining resistors 24 are positioned metal separator plates 30 or 26 which also carry ceramic bushings 23 and certain of the loops of resistors 24 adjoining those separate plates carry studs 28 which are received in those bushings. Separator plates 30 are supported at one end only, alternately by side plates 13 and 14. An end of plate 30 is welded or otherwise affixed to the end of a screw 32 which is threaded through an organic insulating bushing 33 fixed in plates 13 or 14. Free-floating separator plates 26, otherwise like plates 30, above described, are unsupported at both ends. For most purposes we prefer free-floating separator plates 26.

The resistors 24 are formed with an even number of folds or loops. The adjoining ends of side-by-side resistors 24 are joined by welding to metal connector plates 25. The resistor ends so affixed are backed by a ribbed metal heat sink 35 which is tapped to receive screw 37. Those screws pass through washers 42 or organic insulating material, side plates 13 or 14, and circumferentially ribbed organic insulating spacers 36. At some of those junctions terminals 38 are brought out through openings in bottom plate 14. Screw 37 above described passes through washer 42, side plate 14, a block 40 of organic insulating material and is threaded into heat sink 39. Block 40 extends along side member 14 and is formed with a hole 41 adjacent the opening in side member 14 through which hole and opening the outwardly bent end of terminal 38 passes. The free ends 43 of the series-connected resistors 24 are welded to metal angle connectors 44 which extend outwardly between end plate 19 and terminal 15, the three elements being clamped together by screws 45 tapped into holes in terminal 15.

Terminals 15 and 16 hold bottom plate 14 in place by screws 46 which pass through bushings of organic insulating material 47, block 48 of the same material and terminal 15, and are clamped by nuts 49.

Figure 2:
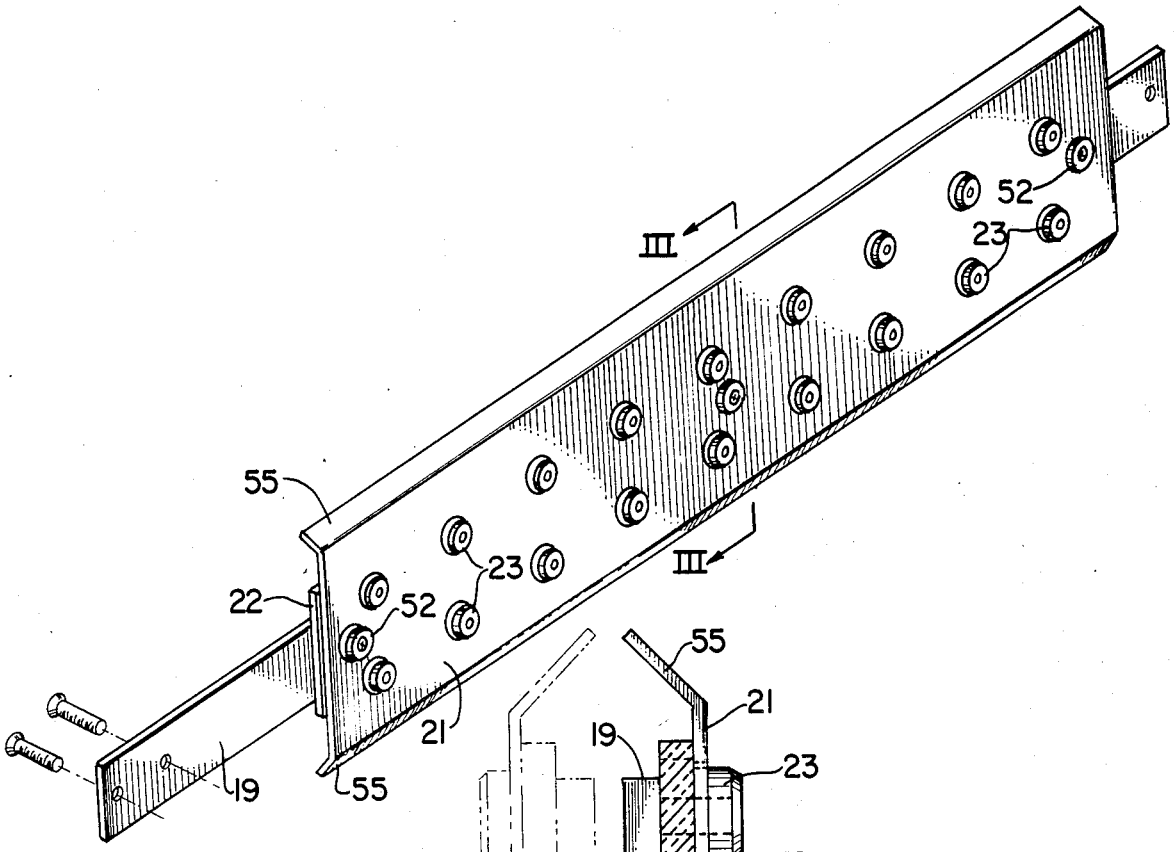
FIG. 2 is a detail of an end panel of the resistor of FIG. 1.
Figure 3:
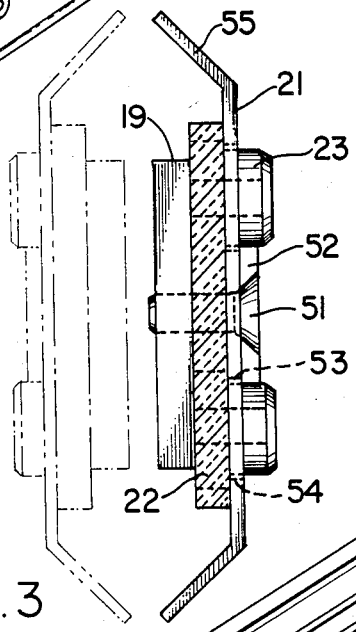
FIG. 3 is a section through the end panel of FIG. 2 taken on the plane III—III.

FIGS. 2 and 3 show in more detail the structure of end members 11 and 12. Panel 22 of organic insulating material is sandwiched between metal end plate 19 and metal heat shield 21. The assembly is held together by screws or other fasteners 51 tapped into end plate 19. Their heads are held in flanged bushings 52 of organic insulating material set in clearance holes 53 in heat shield 21 so that there is no metal-to-metal contact between end plate 19 and heat shield 21, and ceramic bushings 23 are fitted into holes in insulating panel 22 and extend short of panel 19 through clearance holes 54 in heat shield 21 so that there is no ceramic-to-metal contact. Thus, a mounting for resistor ribbon 24 is provided cushioning it as well as insulating it from metal members 19 and 21.

Figure 4:
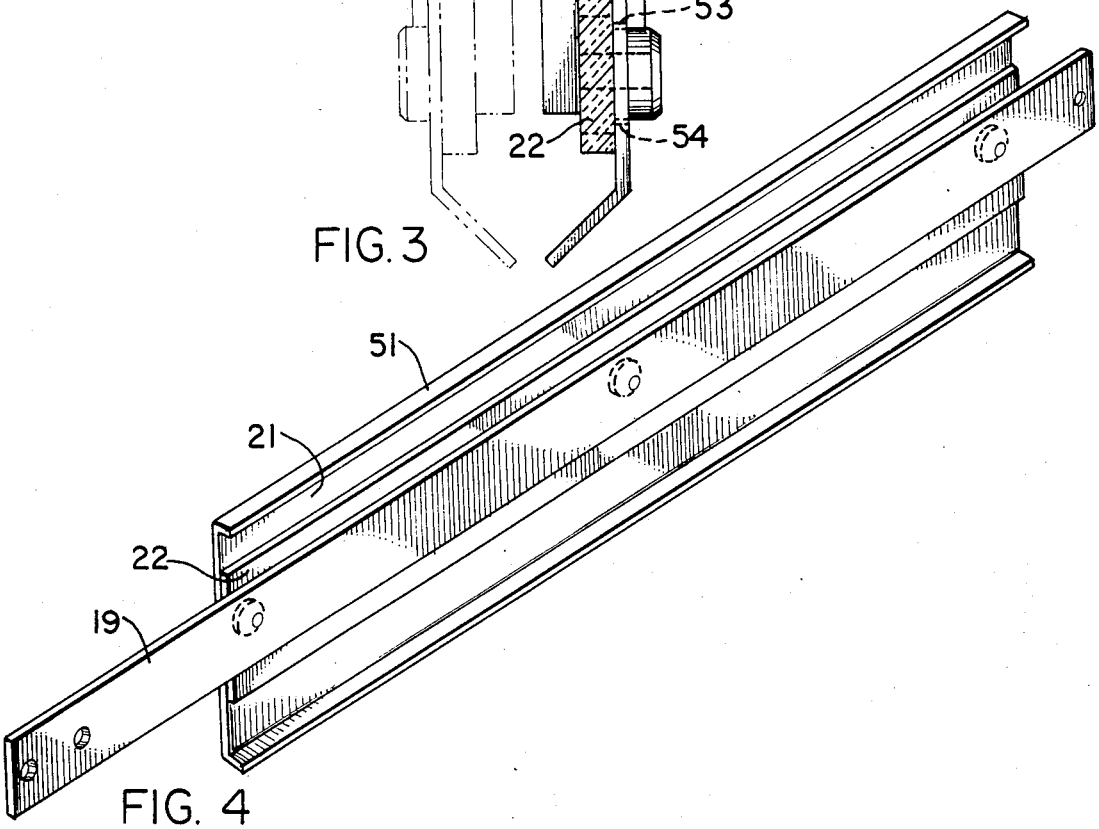
FIG. 4 is an alternative form of end panel.
Figure 6:
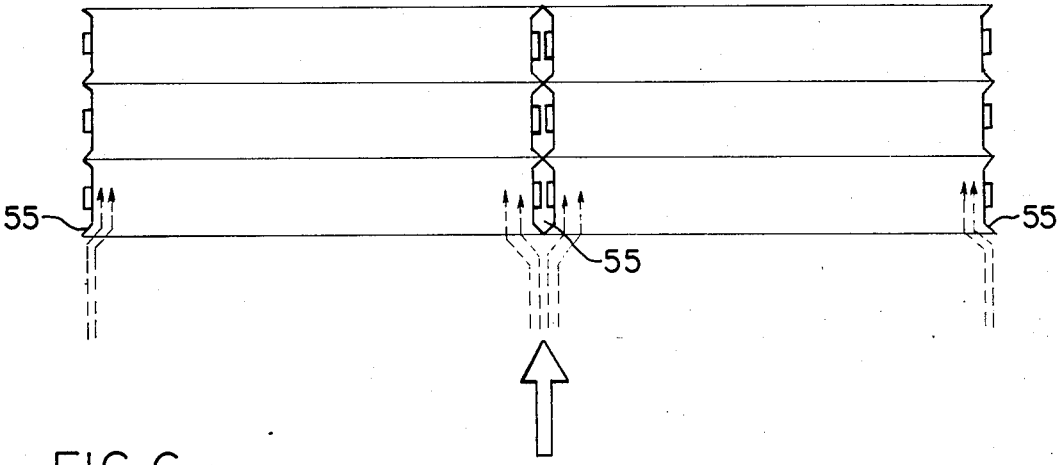
FIG. 6 is a diagrammatic plan of multiple mounting of the resistors of FIG. 1.

We prefer to form heat shield 21 with edge flanges 55 inclined to heat shield 21 at an angle between about 90° and about 180°, such as about 135° as is shown in FIG. 2. When several of our resistors with end members 11 and 12 as shown in FIG. 2 are mounted in grid form, as shown diagrammatically in FIG. 6, flanges 55 divert cooling air blowing through the resistor so that more of it is directed across resistors 24 than would be the case if flanges 55 were normal to heat shield 21. However, in an alternative form of our invention, shown in FIG. 4, flanges 51 are substantially normal to heat shield 21.

Figure 5:
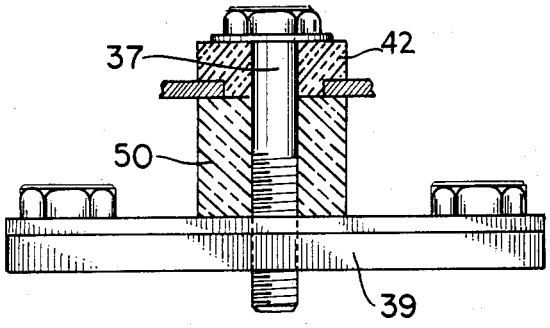
FIG. 5 is a detail of an alternative form of connector plate mounting.

Although we prefer to use circumferentially ribbed organic insulating spacers 36 as mentioned hereinabove we alternatively may use smooth cylindrical spacers 50 as shown in FIG. 5. Likwise although we prefer to use metal heat sinks 35 formed with projecting ribs, also as described hereinabove, we may use flat metal plates 39, also shown in FIG. 5.

Figure 8:
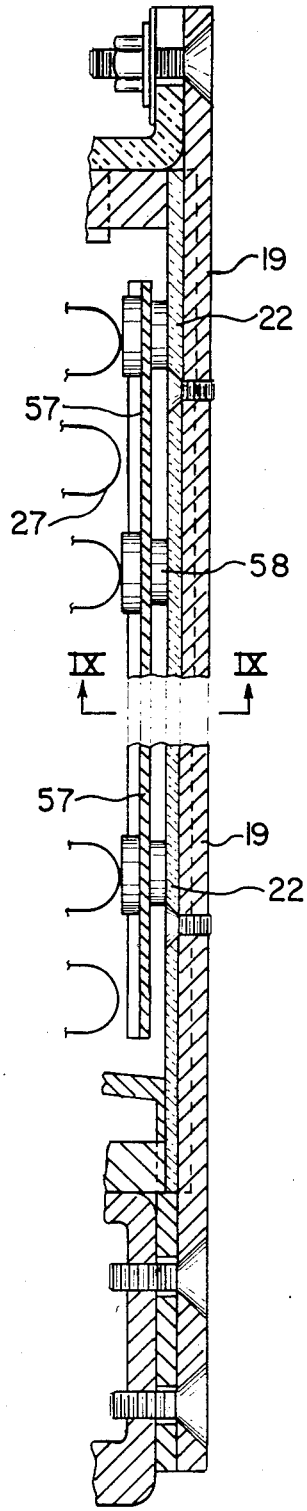
FIG. 8 is a partial section through a second embodiment of our resistor in elevation.
Figure 9:
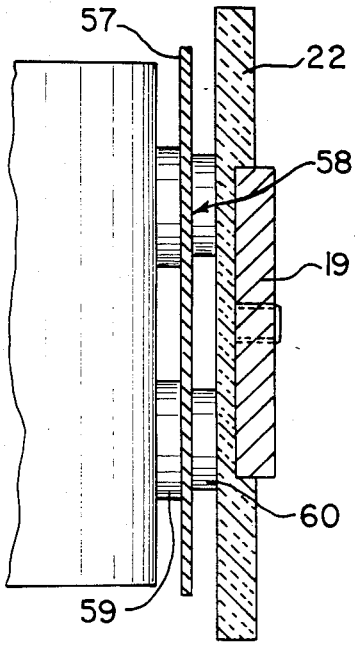
FIG. 9 is a section through the end portion of FIG. 8 taken on the plane IX—IX.

A second embodiment of the resistor of our invention is shown in FIGS. 8 and 9. As before the end panel of our resistor is supported by a metal member 19 to which is affixed a panel of organic insulating material 22. Spaced from panel 22 is a heat-shielding metal panel 57 positioned between resistance element 24 and panel 22 and parallel thereto. Heat-shielding panel 57 carries ceramic bushings 58 set in holes therein and affixed thereto, each bushing having a hole 29 therein to receive a stud 28 affixed to a loop 27 of resistance element 24, as has been shown in FIG. 7. Panel 57 together with bushings 58 may move toward or away from insulating panel 22 in response to expansion and contraction of resistor element 24 so as to provide an air channel of adjustable width between panels 22 and 57. When our resistor is mounted in the position shown in FIG. 1 the resistor ribbons 24 expand as they heat up and tend to droop, thus pulling their studs 28 away from bushings 58 and allowing any convection air moving in the channel between heat shield 57 and insulating panel 22 to widen that channel. Increased air flow therethrough cools organic insulating panel 22.

Figure 10:
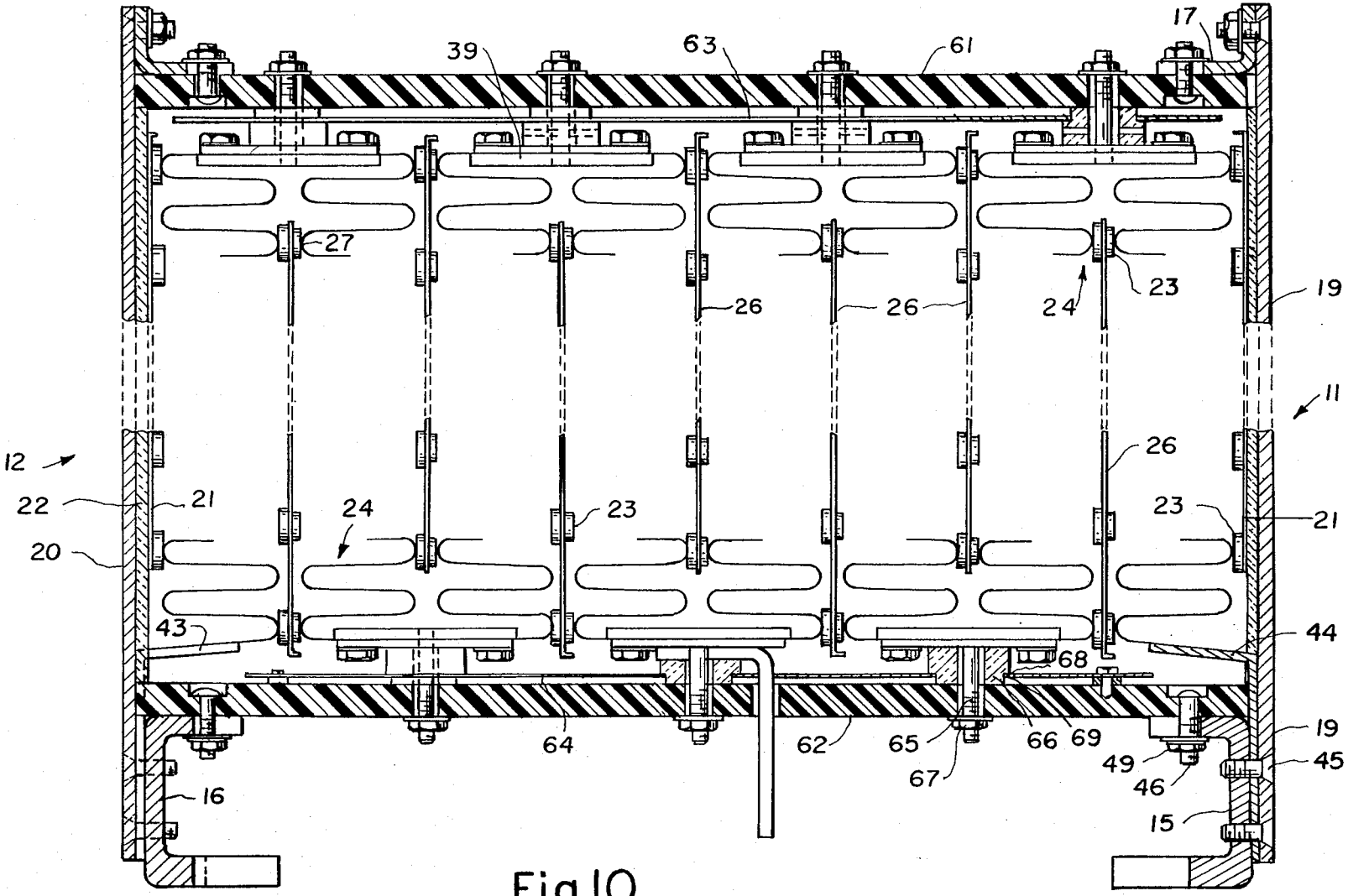
FIG. 10 is a section through a third embodiment of our resistor in elevation.

A third embodiment of our invention is shown in FIG. 10. Like the first two embodiments described hereinabove it has metal end members comprising metal panels 19 and 20 fastened on their inside faces to panels 21 and 22 respectively of organic insulating material. Its top and bottom structural members 61 and 62 however, are organic insulating material. Affixed to the inside faces of those top and bottom members are metal heat shields 63 and 64 respectively spaced from their respective structural members so as to leave an air passage therebetween. The fan-folded resistors 24 are connected together at their ends by connector plates 39 as before. Those connector plates are affixed to top and bottom members 61 and 62 by screws 65 which pass through those connector plates, cylindrical spacers 66 and the top and bottom structural members, and are held in place by nuts 67. The spacers 66 are formed with shoulders 68 and the metal heat shields 63 and 64 have holes therein through which the reduced diameter ends of spacers 66 pass. The heat shields are held against shoulders 68 by retaining rings 69 so as to space the heat shields from the structural insulating members. Heat shield 63 and 64 are conveniently continuous strips of metal.

Figures 11, 12, 13:
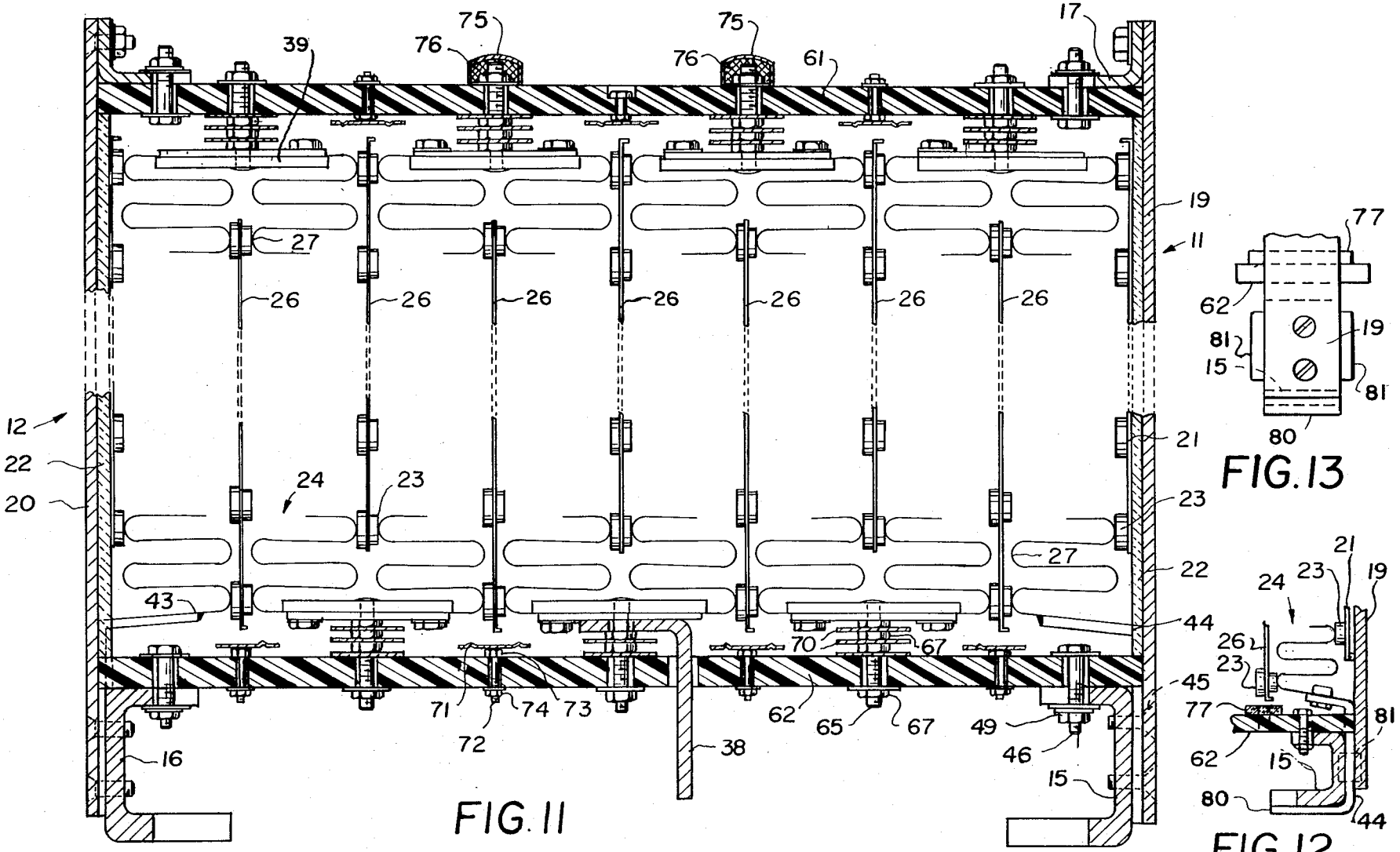
FIG. 11 is a section through a fourth embodiment of our resistor in elevation.
FIG. 12 is a detail of a modification of the article of FIG. 11 in elevation.
FIG. 13 is an end elevation of the structure of FIG. 12.

A modification of the above embodiment is shown in FIG. 11. The top and bottom structural members 61 and 62 of organic insulating material are not here provided with heat shields in the form of continuous strips of metal. As in FIG. 10 the connector plates 39 are fastened to top and bottom members 61 and 62 by screws 65 and outside nuts 67. The connector plates 39 are spaced from the organic insulating top and bottom members by multiple spacers, which may also be nuts 67, and by multiple individual heat shields 70, each held between a pair of spacers 67 on screws 65 or between the spacer adjoining the structural panel and that panel. Heat shields 70 also act as heat dissipating fins to carry away heat conducted by screws 65. Additional heat deflectors or shields 71 are positioned opposite the ends of separator plates 26 and are affixed to top and bottom structural members 61 and 62 by screws 72 and nuts 74. Deflectors 71 are spaced from their supporting organic insulating members by spacers 73 which may be nuts like nut 74. On the top structural members 61 the protruding ends of screws 65 and their mating nuts 67 are covered by plastic enclosures 75 which are held in place by adhesive composition 76. Those enclosures insulate the exposed ends of screws 65.

The embodiment of FIG. 12 has metal end panels 19 and 20 and top and bottom structural members 61 and 62 of organic insulating material, as in our third embodiment. Affixed to the inside faces on panels 19 and 20 but spaced therefrom are metal heat shields 21 as in our first embodiment, in which heat shields are set ceramic bushings 23, the ends of which nearer panels 19 and 20 are spaced therefrom. The heat deflectors 71 of our FIG. 11 opposite the ends of separator plates 26 are replaced by small blocks 77 of high heat resistant insulating material, such as ceramic, fixed to structural member 62.

End terminals 15 and 16 are strengthened by extending the lower ends 80 of metal angle connectors 44 and folding those ends around under the lower faces of terminals 15 and 16. Side plates 81 are welded to the edges of terminals 15 and 16 and to the edges of connectors 44.

Hereinabove we have indicated ceramic insulating material to be preferred in locations where high heat resistance is required. Other materials of like properties may be employed in those locations. In the following claims we describe such material as "heat resistant" and include within that term ceramics and other materials which have heat resistant properties significantly greater than organic insulating materials.

In the foregoing specification we have described presenty preferred embodiments of our invention; however, it will be understood that our invention can be otherwise embodied within the scope of the following claims.

We claim:

1. In a heat-dissipating resistor having a plurality of connected fan-folded electrically conductive resistance elements supported within a rigid frame by studs affixed to loops of said resistance elements and mating heat-resistant insulating elements carried by members of said frame, the improvement in which said members of said frame are metal members and comprising an insulating panel of organic material affixed to an inside surface of said metal member and a metal heat shield surrounding said heat-resistant insulating elements positioned inwardly from said frame member, said heat-resistant insulating elements being fixed in said insulating panel and projecting through said metal heat shield.

2. The resistor of claim 1 in which the said metal frame member is an end member and including metal structural side members.

3. The resistor of claim 2 including a terminal affixed to said end member adjacent a side member, means affixing an end of a resistance element to said end member, a block of organic insulating material interposed between said side member and said terminal and means extending through said block affixing said terminal to said side member.

4. The resistor of claim 2 including a spacer of organic insulating material mounted on said side member, a metal connecting plate connecting the ends of adjoining resistance elements opposite said spacer and metal fastening means extending through said spacer and clamping said connecting plate to said side member and insulating it therefrom.

5. The resistor of claim 1 in which the said metal frame member is an end member and including structural side members of organic insulating material.

6. In combination a frame element and a heat-dissipating resistor element or the like supported thereby in which said frame element comprises a panel of organic insulating material, and including a metal heat shield between said resistor element and said insulating panel, and heat-resistant insulating material spacing said resistor element from said insulating panel affixed to said insulating panel and projecting through said metal heat shield.

7. The combination of claim 6 including a metal structural panel affixed to said panel of organic insulating material on the face thereof opposite said metal heat shield and insulated from said metal heat shield.

8. The combination of claim 6 in which said metal heat shield has flanges extending toward said panel of organic insulating material at an angle to said metal heat shield between about 90° and about 180°.

9. The combination of claim 6 in which said organic insulating material is a polyester resin.

10. The combination of claim 7 in which said metal heat shield is spaced from said metal structural panel by said panel of organic insulating material.

11. The combination of claim 7 in which the heat-resistant insulating material projecting through said metal heat shield is spaced therefrom.

12. The combination of claim 7 in which said organic insulating material is a polyester resin.

13. The combination of claim 7 in which said metal heat shield is spaced inwardly from said panel of organic insulating material so as to form an air channel therebetween.

14. The combination of claim 7 in which said heat-resistant insulating material is fixed in said metal heat shield and said metal heat shield is supported only by said resistance element.

15. In a heat-dissipating resistor having a plurality of fan-folded electrically conducting resistance elements supported within a rigid frame by studs affixed to loops of said resistance and mating heat-resistant insulating elements carried by members of said frame, the improvement comprising a frame having side structural members of organic insulating material and end structural members of metal, said heat-resistant insulating elements being carried by said metal end members, and metal heat shields surrounding said heat resistant insulating elements carried by said side structural members affixed to the inner face thereof.

16. In combination a frame element and a heat-dissipating resistor element or the like supported thereby comprising a structural panel of organic insulating material, a metal heat shield affixed to the inner face of said structural panel and metal supporting means for said resistor element affixed to said structural panel and passing through said heat shield without contacting it.

17. The combination of claim 16 in which said metal heat shield extends continuously over substantially the length of said structural panel.

18. The combination of claim 16 in which said metal heat shield is spaced from said structural panel.

19. The combination of claim 16 in which said metal heat shield is spaced from said structural panel so as to form an air channel therebetween.

20. The combination of claim 17 or 18 in which said heat dissipating resistor comprises a plurality of fan-folded electrically conductive resistance elements connected by connector plates supported by support members from said side structural members and said metal heat shields are likewise supported by said support members.

21. The combination of claim 16 in which said heat dissipating resistor comprises a plurality of fan-folded electrically conducting resistance elements connected by metal connector plates and said metal supporting means are affixed to said metal connector plates.

22. The combination of claim 16 in which the ends of said metal supporting means for said resistor element protrude through said structural panels, and including insulating enclosures affixed to said protruding ends.

23. In a heat dissipating resistor having a plurality of fan-folded electrically conducting resistive elements positioned within a rigid frame by studs, affixed to loops of said resistance elements and mating heat resistant insulating elements carried by metal separator plates, the improvement comprising a frame having structural side members of organic insulating material protected by heat resistant insulating material on their inner faces opposite said separator plates.

* * * * *